US006254422B1

(12) United States Patent
Feye-Hohmann

(10) Patent No.: US 6,254,422 B1
(45) Date of Patent: Jul. 3, 2001

(54) ELECTRONIC TERMINAL FOR USE ON CIRCUIT BOARDS

(75) Inventor: Jurgen Feye-Hohmann, Detmold (DE)

(73) Assignee: Phoenix Contact GmbH & Co., Blomberg (DE)

( * ) Notice: Subject to any disclaimer, the term of this patent is extended or adjusted under 35 U.S.C. 154(b) by 0 days.

(21) Appl. No.: 09/690,873

(22) Filed: Oct. 18, 2000

Related U.S. Application Data

(63) Continuation-in-part of application No. 09/138,503, filed on Aug. 24, 1998, now abandoned.

(30) Foreign Application Priority Data

Aug. 25, 1997 (DE) ..... 197 36 739

(51) Int. Cl.[7] ..... H01R 4/24; H01R 4/26; H01R 11/20

(52) U.S. Cl. ..... 439/441

(58) Field of Search ..... 439/436, 437, 439/438, 439, 440, 441, 268, 725

(56) References Cited

U.S. PATENT DOCUMENTS 5,494,456 * 2/1996 Kozel et al. ..... 439/441
5,795,179 * 8/1998 Lin ..... 439/441
5,895,286 * 4/1999 Linke ..... 439/441

* cited by examiner

*Primary Examiner*—Brian Sircus
*Assistant Examiner*—Javaid Nasri
(74) *Attorney, Agent, or Firm*—Charles E. Baxley

(57) ABSTRACT

A terminal has a box spring out of whose wall there is cut at least one elastic terminal leg which is bent into the inside of the box toward an opposing abutment and which has a free terminal end between which the abutment and an electric conductor can be clamped. An actuating part having a projecting pusher end is arranged in the box spring and can be displaced toward the terminal end of the terminal leg. When pushed in, the actuating part with its inside end is pushed as a wedge between the abutment and the terminal leg, thus releasing a clamped electric conductor. The actuating part has a through-channel for insertion of the electric conductor which extends from the conductor insertion orifice on the pusher end to a conductor outlet orifice.

12 Claims, 5 Drawing Sheets

ELECTRONIC TERMINAL FOR USE ON CIRCUIT BOARDS

This application is a continuation-in-part of my application for ELECTRONIC TERMINAL FOR USE ON CIRCUIT BOARDS, Ser. No. 09/138,503 filed on Aug. 24, 1998 now abandoned.

FIELD OF THE INVENTION

The present invention relates generally to the field of electrical connectors and more particularly, to a miniature electric terminal for use on circuit boards.

BACKGROUND OF THE INVENTION

German Patent DE 4 231 244 C2 discloses an electric terminal which includes a terminal block for mounting rails which incorporates the principle of a block spring. The clamping force for the conductor is created by an elastic terminal leg which is bent into the box spring.

The actuating part in the form of a pusher, for opening, acts like a wedge which is pushed between the terminal leg and an abutment to lift the terminal leg away from the abutment and the clamped conductor. However, the known arrangement is intended only to have a single clamping point, and is designed largely for use on large circuit board cross sections in accordance with rail-mountable row terminals. Accordingly, the actuating part and the conductor entry are designed so they are spatially separated from one another.

OBJECTS AND SUMMARY OF THE INVENTION

It is an object of the present invention to provide an electric terminal for use on circuit boards which features a reduced overall component size without interfering with access for operation.

Another object of the present invention is to provide an electric terminal for use on circuit boards which has a reduced number of internal components.

Another object of the present invention is to provide an electric terminal for use on circuit boards which is capable of reliable long-term operation.

Another object of the present invention is to provide an electric terminal for use on circuit boards which incorporates a box spring.

The foregoing and other objects and advantages of the present invention will appear more clearly hereinafter. In accordance with the present invention, there is provided an electric terminal for use on circuit boards which incorporates a spring force element in the form of a box spring.

At least one elastic terminal leg is cut free from the wall of the box spring and bent back into the interior of the box in the direction of an opposite abutment; it has a free terminal end, so that an electric conductor can be clamped between the abutment and this free terminal end. An actuating part that is displaceable in the longitudinal direction of the terminal leg is arranged in the box spring; it projects with one end of the pusher out of an orifice in the box spring on a coupled side of the terminal, and when depressed, it is pushed with its inside wall as a wedge between the abutment and the terminal leg, lifting the latter away from the abutment and the clamped conductor.

Essentially the use of the box springs contributes toward minimization of components, since their design with the abutment and the minimum of one terminal leg does not require any additional contact point. In this regard, the box spring is designed so that the terminal leg(s) are punched out of the back of the box spring and bent toward the abutment. A design with multiple independent terminal legs is easily manufactured and is advantageous because the terminal legs lying side by side contribute to a higher contact density. An arrangement with more than three connecting points per box spring can easily be implemented. The box-like design of the springs is also advantageous because in addition to the desired stability due to the pressing forces of the terminal legs, there is also enough room to accommodate at least one actuating part. Due to advantageous cutouts punched into the side faces of the box spring, the respective terminal housing and the actuating part can easily be engaged with the box spring in the joining operation. This feature has an additional advantage that the actuating part cannot be pulled away from the spring force terminal because of faulty assembly.

According to the present invention, the actuating part with such a terminal has a through-channel for passing the conductor through, and this through-channel extends from a conductor insertion orifice on the pusher end up to a conductor outlet orifice on the inside end of the actuating part.

The embodiment of the actuating part according to the present invention supports the terminal density of the electric terminal in that the actuating part and the through-channel for the conductor, including the conductor insertion orifice, are integrated into one another.

Depending on given space requirements and the clamping effect, the abutment in the inside of the box spring in an advantageous embodiment of this invention may be formed by a box wall opposite the terminal leg or by a second terminal leg. In the latter case, the second terminal leg is cut free from the wall of the box spring opposite the first terminal leg and is then bent inward the opposite first terminal leg.

The box spring is arranged in a terminal housing made of insulation material for reasons of electrical insulation. The pusher end of the undisplaced actuating part which is also made of insulation material projects out of said terminal housing together with a projecting actuating face on which the conductor insertion orifice is located. The conductor insertion orifice is expediently arranged off-center on the actuating face of the pusher end to make available a sufficiently large area for actuation either by hand or by means of a tool. Threading the conductor into the through-channel of the actuating part is further facilitated by the fact that the through-channel is widened in a funnel shape in the direction of the conductor insertion orifice.

The special design of the actuating part makes it possible for either a one-piece actuating part to be used for multiple conductors whose terminal leg opens at the same time, or a multi-part actuating part may permit individual clamping of multiple conductors. Accordingly, the box spring then has two or more terminal legs arranged side by side with corresponding abutments, and the actuating part has a corresponding number of through-channels and conductor insertion orifices, or the actuating part is designed in two or more parts, with each element of the actuating part having a separate through-channel in the latter case and being displaceably independent of the other elements. The elements of the multi-part actuating part are connected to one another by guide elements which permit independent operation of the elements.

The actuating part preferably is secured in the terminal house by latching. In the case of a multi-part actuating part, latching in the composite may be provided so that the individual elements of the actuating part do not fall out of the housing of the terminal.

On the whole, the terminal also has a box-like structure which permits a very simple alignment of multiple terminals in a row with their terminal housing arranged to form a block terminal. The insulating terminal housing can be positioned closely side by side, thus permitting an advantageous compact arrangement if the terminal housings can be joined together by means of latches or tongue-and-groove joints to form a solid block. In this way, any desired number of terminals can be produced per terminal block. Furthermore, a terminal housing can be provided that has a plurality of receptacle spaces for multiple box springs; such as a prefabricated, one-piece terminal block which has a plurality of contacting points arranged closely side by side for a corresponding number of electric conductors in accordance with the design of the actuating parts and their through-channels, and conductor insertion orifices.

DESCRIPTION OF THE DRAWING

Other important objects and advantages of the present invention will be apparent from the following detailed description taken in connection with the accompanying drawings wherein like numerals refer to like parts and in which.

DETAILED DESCRIPTION OF THE INVENTION

With reference to the drawings, wherein like reference numbers designate like or corresponding parts throughout, there is shown in FIGS. 1–7 an electrical terminal for use on circuit boards made in accordance with the present invention.

Figure 1:
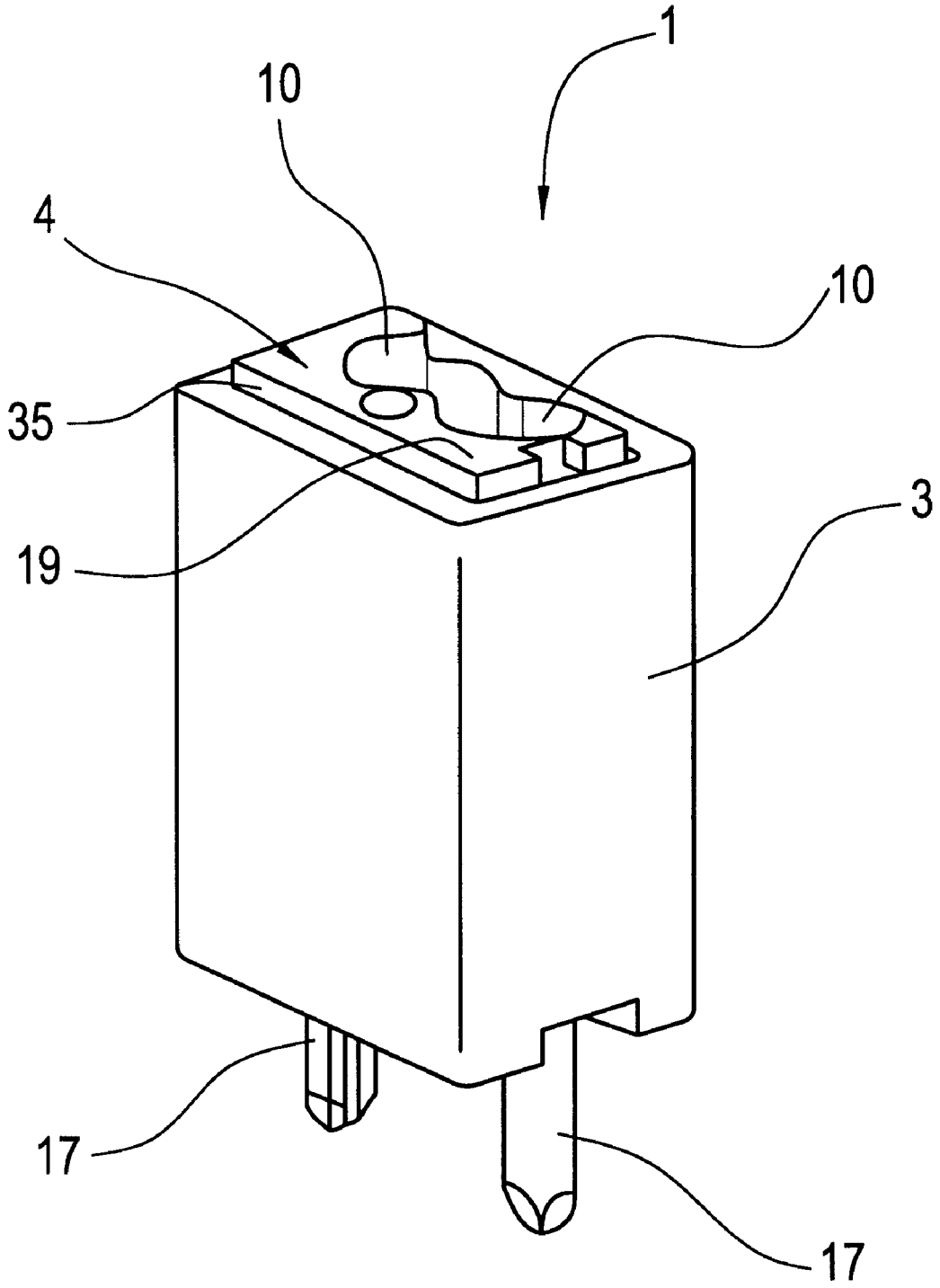
FIG. 1 is an overall perspective view of an electric terminal for use on circuit boards which incorporates two conductors.
Figure 2:
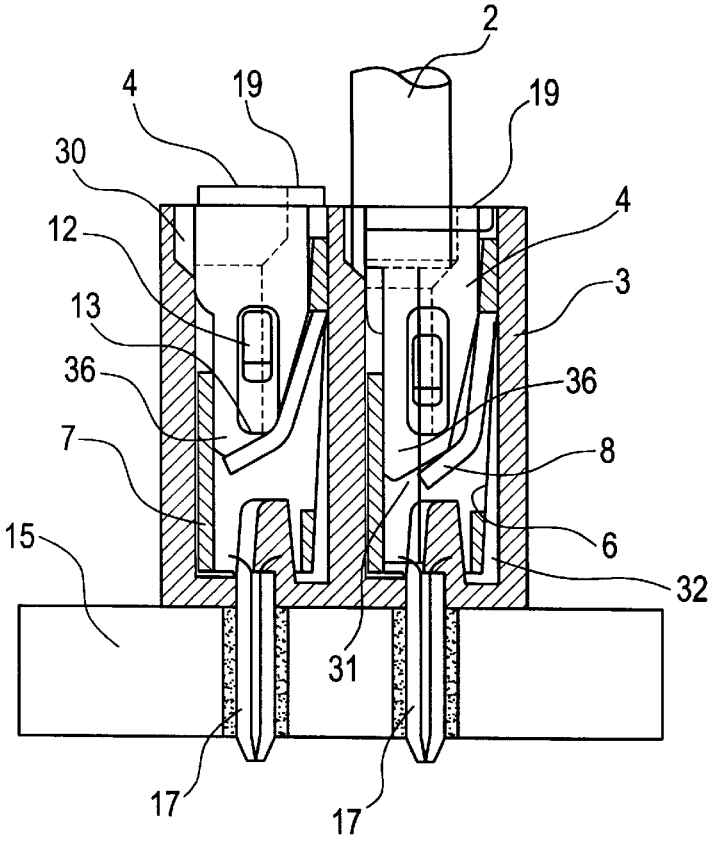
FIG. 2 is a vertical cross-sectional view of the electric terminal of FIG. 1, showing the electric terminal installed on a circuit board and showing two conductors connected to the electric terminal.
Figure 3:
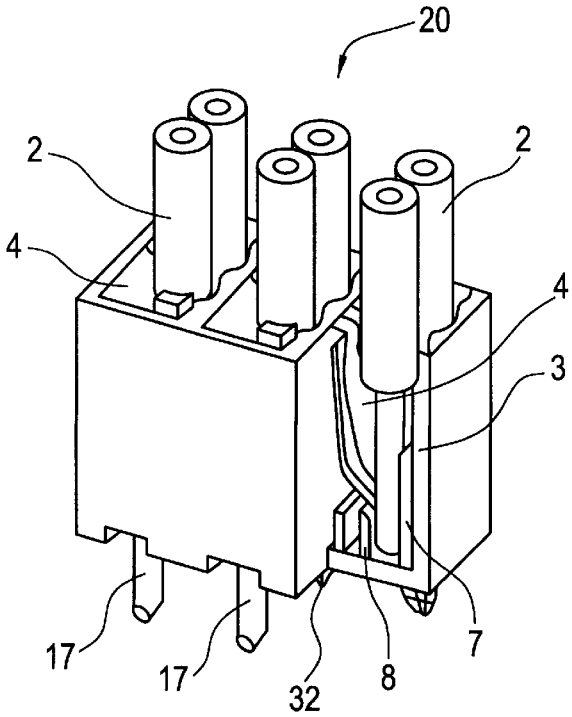
FIG. 3 is a perspective view, partially cut away, of an alternative embodiment of the invention for connection of six conductors.

FIG. 1 shows a terminal 1 which can also be referred to as a spring force terminal element. Terminal 1 as shown in FIG. 1 is designed for connecting two electric conductors 2, as shown in FIGS. 2 and 3. It is also possible to design terminal 1 for connecting only a single conductor, in which case the width of terminal 1 can be further reduced. Terminal 1 with the two conductor connections according to FIG. 1 can be produced for a contact grid of 3.82 mm or smaller.

Terminal 1 has a terminal housing 3 which accommodates a metal box spring 5 and an actuating part 4, with the actuating part 4 projecting out of the terminal housing 3 with a pusher end 35. Accordingly, the box-shaped terminal housing 3 which has essentially a rectangular cross-section, has an orifice at the end which is filled by the pusher end 35 of the actuating part 4. The pusher end 35 of the actuating part 4 has on the end an actuating face 19 which can be acted upon by hand or means of a tool to displace the actuating part 4 and especially the pusher end 35 in the direction of the interior of terminal housing 3. Terminal housing 3 and actuating part 4 are made of an insulation material.

FIG. 1 also shows conductor insertion orifices 10, each of which is assigned to one of the conductors to be connected. Conductor insertion orifices 10 are located on the actuating face 19 of pusher end 35 and are optionally arranged off-center here to make available enough large continuous area for actuation. Terminal 1 can be connected electrically to a circuit board by means of two soldering spines 17, which extend out of terminal housing 3 from the end opposite the pusher end 35.

Figure 5:
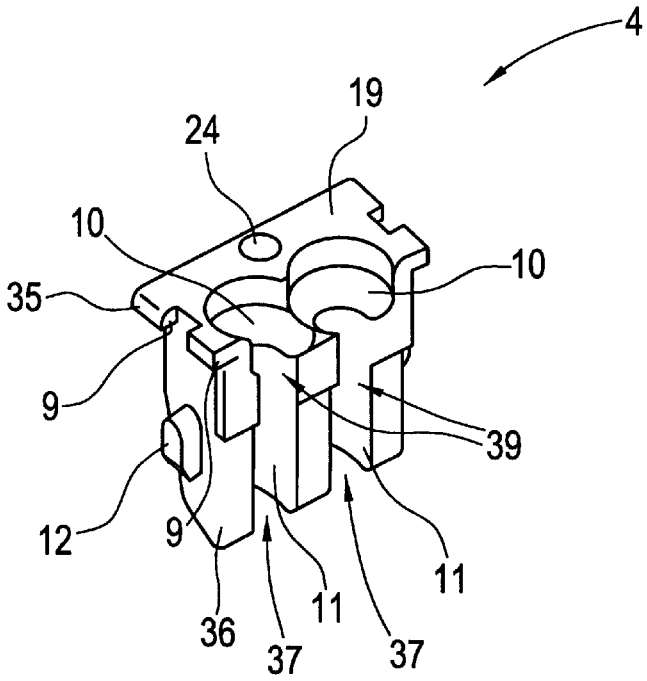
FIG. 5 is a perspective view of the actuating member of the electric terminal of FIG. 1.

As is shown in FIG. 2, two terminals 1 are combined into one block and are inserted into a circuit board 15. FIG. 2 shows that the connected electric conductor 2 passes through the actuating part 4. As shown in FIG. 5, actuating part 4 has two through-channels 11 arranged in the direction of displacement, connected to the conductor insertion orifices 10. Through-channels 11 each extend from the conductor insertion orifices 10 on the pusher end 35 to a conductor outlet orifice 37 on the inside end 36 of the actuating part 4.

Figure 4:
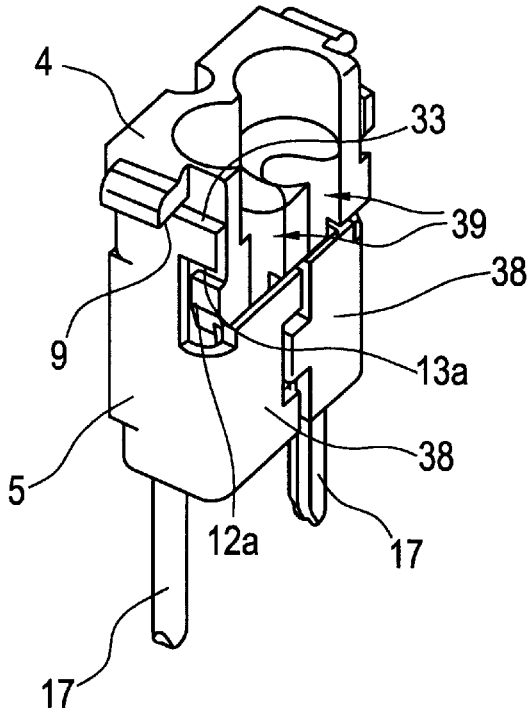
FIG. 4 is a perspective view of the box spring of the electric terminal of FIG. 1.

FIG. 2 also shows that the actuating part 4 is arranged displaceably in a box spring 5 which is in a terminal housing 3. The entire arrangement of the actuating part 4 and box spring 5 is shown in FIG. 4, and the box spring 5 is shown separately in FIG. 6. Box spring 5 and actuating part 4 according FIG. 4 are a unit that can be preassembled, with actuating part 4 being held displaceably in box spring 5 by means of lock parts 12*a* arranged at the sides and bordering orifices 13*a*. Terminal housing 3 may have a honeycomb design according to accommodate a plurality or a multitude of such units according FIG. 4. On its inside end, box spring 5 is provided with a web 32 that can be overlapped by catch devices on the inside of terminal housing 3.

On the pusher end 35 of the actuating part 4, stop shoulders 9 which limit the displacement path of the actuating part 4 in the direction of the inside of the box spring 5 project on the narrow sides. With these stop shoulders 9, the actuating part 4 in the inserted end position sits on a top edge 33 of the box spring 5. Top edge 33 borders the end orifice 34 of box spring 5 through which the actuating part 4, except for its pusher end 35, can be inserted into the interior of the box spring 5.

Figure 6:
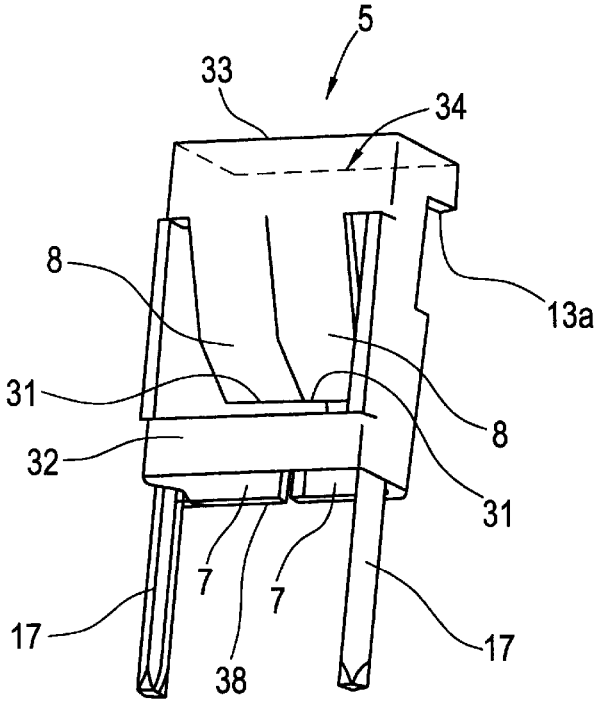
FIG. 6 is a perspective view of the box spring of the electric terminal of FIG. 1, similar to FIG. 4, showing the box spring from the opposite side.

As FIGS. 2 and 6 show, the box spring 5 is designed for two contacting points. It has two terminal legs 8 which project into the displacement path of the actuating part 4, where these elastic terminal legs 8 have been cut free from the wall of the box spring 5 and extend into the interior of the box and are bent in the direction of the opposite wall 38 of the box spring 5. This opposite wall 38 of the box spring 5 forms with its inside an abutment 7 which works together with a free terminal end 31 of the respective terminal leg 8. Each terminal leg is hinge-connected to the box spring 5 on the part of the wall toward the upper end orifice 34 and extends lengthwise along actuating part 4. Actuating part 4 has an inside end 36 which tapers in a wedge shape end is in contact with the inside of the respective terminal leg 8 of the box spring 5. Because of the spring elasticity of the terminal leg 8, the actuating part 4 is kept in the undisplaced position in its starting position, where the pusher end 35 of the actuating part 4 projects out of the terminal housing, as shown in FIG. 2. Due to the force acting on the pusher end 35 of the actuating part 4, the respective terminal leg 8 with its terminal end 31 is moved away from abutment 7 against direction of the spring force, thus causing the respective terminal 1 to open.

Overstressing of terminal leg 8 is prevented by the fact that the stop shoulders 9 come to rest against pusher end 35 of the actuating part 4 on the top edge 33 of the box spring 5.

For clamping, the respective electric conductor 2 is inserted through the proper conductor insertion orifice 10 into the through-channel 11 of the actuating part 4 from its actuating face 19, namely until conductor 2 has come into contacting engagement with the terminal end 31 of terminal leg 8, displacing terminal leg 8 away from abutment 7. Therefore, terminal end 31 is designed as a terminal leg contact edge which reinforces its mechanical clamping pressure when tension is applied to conductor 2 due to the angle with respect to the axis of the conductor. However, if electric conductor 2 is to be disconnected from terminal 1, the actuating part 4 must be inserted further into the inside of terminal housing 3 or box spring 5, so that terminal leg 8 is lifted further away from abutment 7, and terminal end 31 of terminal leg 8 releases the conductor 2.

As FIG. 2 also shows clearly, one can see by the position of actuating part 4 whether or not conductor 2 is clamped satisfactorily. With vertical arrangement of terminal 1, the actuating part 4 moves downward due to yielding of terminal leg 8 in clamping the conductor 2, so that pusher end 35 of actuating part 4 enters terminal housing 3 partially or completely. However, if when conductor 2 has been inserted, pusher end 35 of actuating part 4 projects further out of terminal housing 3, this is a sign that conductor 2 is not properly clamped.

FIG. 4 also shows a test pick-off orifice, which extends through the pusher end 35 of the actuating part 4. This makes it possible for testing of the electrical connection to be performed with terminal 1 assembled, because jogging contact with the upper edge 33 of box spring 5 is established through test pick-off orifice 24.

As indicated by its name, box spring 5 has a box-like shape due essentially to a rectangular cross-section or a rectangular sheathing. Likewise, terminal housing 3 is also designed with a box shape and has a corresponding receptacle space 6 for box spring 5. Insertion of conductor 2 into the respective through-channel 11 of the actuating part 4 is facilitated by a funnel-shaped enlargement of the conductor insertion orifices. The conductor insertion orifices 10 and through-channel 11 of the actuating part 4 can be open on one side, and they can then be closed by terminal housing 3 on the open side. In this case, terminal housing 3 may have a conductor insertion recess 30 in the area of the insertion side, continuing the peripheral contour of the conductor insertion orifice 10.

FIG. 3 shows a terminal block 20 with a total of six conductors 2 inserted. This diagram illustrates the contact density that can be achieved by aligning rows of terminals 1 in a common terminal housing 3 with multiple receptacle spaces 6. As mentioned previously, such a design can be expanded to the shape of a honeycomb with a multitude of terminals 1, where it is possible to combine more than two contacting points for conductors 2 side by side at potential, represented here by contacts 17. Accordingly, box springs 5 which are used have multiple terminal legs 8 and abutments 7; to this extent there may also be more than the two conductors 2 per terminal shown here.

Figure 7:
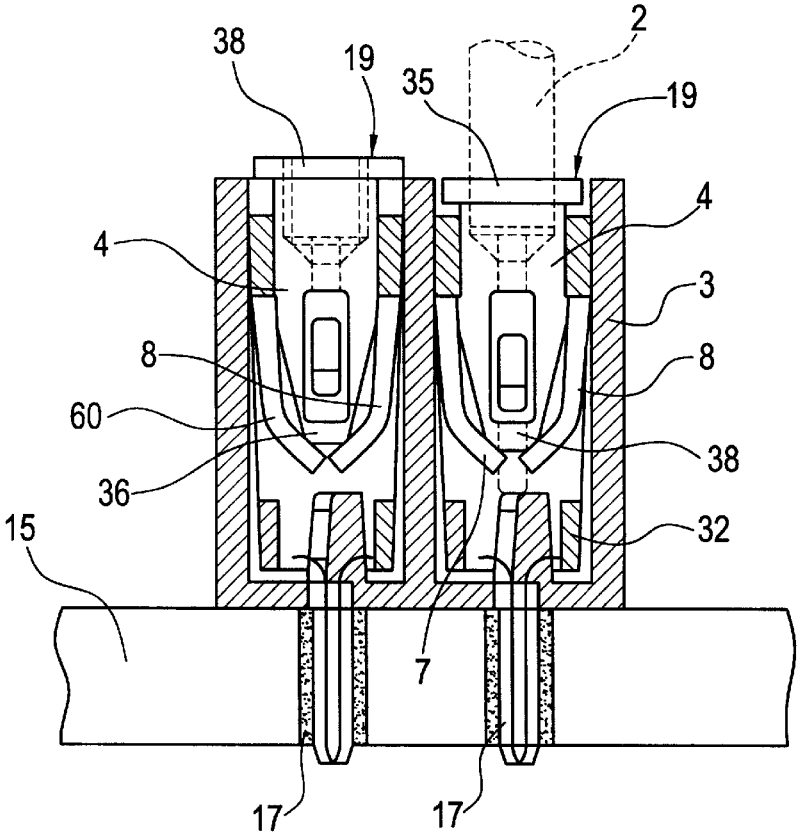
FIG. 7 is a vertical cross-sectional view similar to FIG. 2, showing another alternative embodiment in which the abutment for the terminal leg is formed by a second terminal leg of the respective box spring.

Finally, FIG. 7 shows clearly that instead of having an abutment formed by its wall, box spring 5 may have a second terminal leg 60 as an abutment which is in mirror image to the first terminal leg 8 and is cut out of the wall of box spring 5 in the same way.

Figure 8:
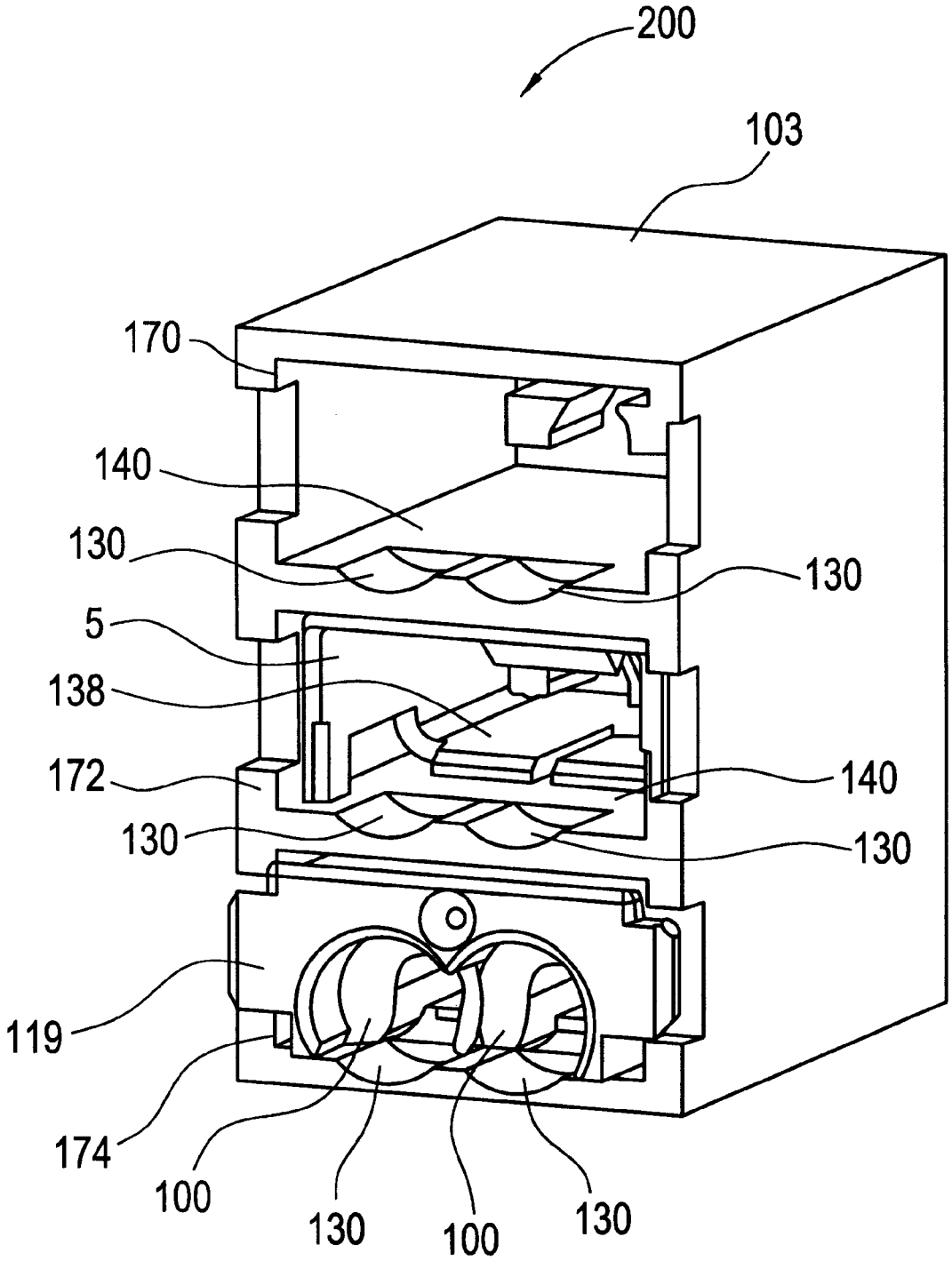
FIG. 8 is an overall perspective view of an alternative embodiment of the invention.

FIG. 8 shows an alternative embodiment of the invention 200, in which an alternative housing 103 is shown as having three chambers 170, 172, 174. For purpose of illustration the upper chamber 170 has been shown empty. A box spring 5 has been shown inserted into the middle chamber 172. A box spring 5 and an actuating part 119 have been shown inserted into the lower chamber 174. The actuating part 119 is similar to the actuating part 4. The actuating part 4 and the box spring 5 have both been described previously.

The overall structure and function of the housing 103 shown in FIG. 8 is similar to the housing 3 which has been shown in FIG. 3 and which has been previously described. The main new features which are shown in FIG. 8 are the recesses or grooves 130 which correspond to the conductor insertion orifices 100 which are similar to the conductor insertion orifices 10 which have been previously described in connection with FIG. 1.

The grooves 130 complete the periphery of the insertion orifices 100. The orifices 100 allow the insertion of conductors into the terminal 200.

The diameter of the orifices 100 is greater than the diameter of the through channels 11 which are shown in FIG. 5. The through channels 11 and the orifices 100 can be advantageously located away from the middle of the actuating part 4. This facilitates the miniaturization of the terminal while providing a relatively large actuating part 119 as shown in FIG. 8.

The walls 138 and 140 close the lateral slots 39 of the actuating part 4. The lateral slots are shown in FIGS. 4 and 5.

The foregoing specific embodiments of the present invention, as set forth in the specification herein, are for illustrative purposes only. Various deviations and modifications can be made within the spirit and scope of this invention, without departing from the main theme thereof.

I claim:

1. An electric terminal comprising:

a spring force means, defining an inside and an outside and said spring force means having a plurality of wall portions, a plurality of abutments and an orifice means;

a first elastic terminal leg means, said first elastic terminal leg means inserted into said inside of said spring force means toward one of said plurality of abutments, with said first elastic terminal leg means having a longitudinal direction and a transverse direction;

an actuating part, said actuating part displaceable in said longitudinal direction of said first elastic terminal leg means with said actuating part disposed inside said spring force means, said actuating part projecting out through said orifice means, said actuating part comprising a pusher end; said pusher end disposed between one of said plurality of said first elastic terminal leg means, thereby lifting said first elastic terminal leg means away from one of said abutments, said actuating part further comprising;

a conductor insertion orifice means;

a conductor outlet orifice means;

a through-channel means extending between said conductor insertion orifice means and said conductor outlet orifice means.

2. The electric terminal as claimed in claim 1, wherein said abutment means is formed by one of said wall portions.

3. The electric terminal as claimed in claim 1, further comprising:

a housing means, said spring force means disposed in said housing means, said pusher end of said actuating part comprising a projecting actuating face with said conductor insertion orifice disposed on said projecting actuating face.

4. The electric terminal as claimed in claim 1, wherein said conductor insertion orifice means is disposed eccentrically on said actuating face.

5. The electric terminal as claimed in claim 1, wherein said through-channel means comprises a funnel-shaped portion said funnel-shaped portion having a relatively wider portion disposed proximate to said conductor insertion orifice.

6. The electric terminal as claimed in claim 1, wherein said spring force means comprises: at least two elastic terminal legs; said elastic terminal legs arranged side-by-side, and at least two abutments each corresponding to one of said at least two elastic terminal legs, and in which said actuating part comprises:

at least two through-channels corresponding to said at least two elastic terminal legs and at least two conductor insertion orifices corresponding to said at least two elastic terminal legs.

7. An electric terminal comprising:

a multiplanar spring force means, said multiplanar spring force means defining an inside and an outside and said multiplanar spring force means having a plurality of wall portions forming a box, a plurality of abutments and an orifice means:

a first elastic terminal leg means, said first elastic terminal leg means inserted into said inside of said multiplanar spring force means toward one of said plurality of abutments, said first elastic terminal leg means having a longitudinal direction and a transverse direction;

an actuating part, said actuating part displaceable in said longitudinal direction of said first elastic terminal leg means, said actuating part disposed inside said multiplanar spring force means, said actuating part projecting out through said orifice means, said actuating part comprising a pusher end; said pusher end disposed between one of said plurality of abutment means and said first elastic terminal leg means, thereby lifting said first elastic terminal leg means away from said abutment means, said actuating part further comprising:

a conductor insertion orifice means;

a conductor outlet orifice means;

a through-channel means extending between said conductor insertion orifice means and said conductor outlet orifice means wherein said abutment means is formed by one of said wall portions of said multiplanar spring force means.

8. The electric terminal as claimed in claim 7, wherein said abutment comprises:

a second terminal leg means, said second terminal means formed on one of said wall portions opposite said first terminal leg means.

9. An electrical terminal comprising:

a multiplanar spring force means, said multiplanar spring force means defining an inside and an outside and said multiplanar spring force means having a plurality of wall portions forming a box, a plurality of abutments and orifice means;

a first elastic terminal leg means, said first elastic terminal leg means inserted into said inside of said multiplanar spring force means toward one of said abutments, said first elastic terminal leg means having a longitudinal direction and a transverse direction;

an actuating part, said actuating part displaceable in said longitudinal direction of said first elastic terminal leg means, said actuating part disposed inside said multiplanar spring force means, said actuating part projecting out through said orifice means, said actuating part comprising a pusher end; said pusher end disposed between one of said abutment means and said first elastic terminal leg means, thereby lifting said first elastic terminal leg means away from said abutment means, said actuating part further comprising:

a conductor insertion orifice means;

a conductor outlet orifice means;

a through-channel means extending between said conductor insertion orifice means and said conductor outlet orifice means wherein said abutment means is formed by one of said wall portions of said multiplanar spring force means and wherein said conductor insertion orifice means and said through channel means are open on one side.

10. The electric terminal as claimed in claim 9, further comprising:

a terminal housing disposed for closing said conductor insertion orifice means and said through channel means.

11. An electric terminal comprising:

a multiplanar spring force means, said multiplanar spring force means defining an inside and an outside and said multiplanar spring force means having a plurality of wall portions forming a box, a plurality of abutments and an orifice means;

a first elastic terminal leg means, said elastic terminal leg means inserted into said inside of said multiplanar spring force means toward one of said abutments, said first elastic terminal leg means having a longitudinal direction and a transverse direction;

an actuating part, said actuating part displaceable in said longitudinal direction of said first elastic terminal leg means said actuating part disposed inside said multiplanar spring force means, said actuating part projecting out through said orifice means, said actuating part comprising a pusher end, said pusher end disposed between said abutment means and said first elastic terminal leg means, thereby lifting said first elastic terminal leg means away from said abutment means with said actuating part further comprising:

a conductor insertion orifice means;

a conductor outlet orifice means;

a through-channel means extending between said conductor insertion orifice means and said conductor outlet orifice means wherein said abutment means is formed by said one of said wall portions of said multiplanar spring force means and wherein said conductor insertion orifice means and said through channel means are open on one side and wherein said conductor insertion orifice means is disposed eccentrically on said actuating part, a terminal housing disposed for closing said open side of said conductor insertion orifice means and said through channel means.

12. An electronic terminal comprising:

a spring force means, defining an inside and an outside and said spring force means having a plurality of wall portions, a plurality of abutments and an orifice means;

a first elastic terminal leg means, said first elastic terminal leg means inserted into said inside of said spring force means toward one of said plurality of abutments, said first elastic terminal leg means having a longitudinal direction and a transverse direction;

an actuating part, said actuating part displaceable in side longitudinal direction of said first elastic terminal leg means with said actuating part disposed inside said spring force means, said actuating part projecting out through said orifice means, said actuating part comprising a pusher end; said pusher end disposed between said abutment and said first elastic terminal leg means, thereby lifting said first elastic terminal leg means away from one of said abutments, said actuating part further comprising:

a conductor insertion orifice means;

a conductor outlet orifice means;

a through-channel means extending between said conductor insertion orifice means and said conductor outlet orifice means, with said through channel means further comprising groove means.

* * * * *